US005988636A

United States Patent [19]

Kilmer

[11] Patent Number: 5,988,636

[45] Date of Patent: Nov. 23, 1999

[54] MULTI-GAME TABLE TOP SYSTEM

[76] Inventor: James A Kilmer, 1132 Banes Rd., Southampton, Pa. 18966

[21] Appl. No.: 09/019,109

[22] Filed: Feb. 5, 1998

Related U.S. Application Data

[63] Continuation of application No. 08/689,597, Aug. 12, 1996, abandoned.

[51] Int. Cl.[6] ..... A63F 7/06

[52] U.S. Cl. ..... 273/108.1; 273/108; 273/108.2; 273/118 R; 273/119 R; 273/123 R; 273/284

[58] Field of Search ..... 273/108, 108.1, 273/108.2, 118 R, 119 R, 123 R, 126 R, 236, 287, 284, 277

[56] References Cited

U.S. PATENT DOCUMENTS

| | | | |
|---|---|---|---|
| 1,875,198 | 8/1932 | Nagai | 273/108.2 X |
| 1,899,546 | 2/1933 | Wilson | 273/108.2 X |
| 3,224,777 | 12/1965 | Cirasunda | 273/DIG. 26 |
| 3,871,650 | 3/1975 | Casey | 273/108.21 |
| 4,095,793 | 6/1978 | Ray | 273/108.21 |
| 4,123,058 | 10/1978 | Furyk et al. | 273/108.21 |
| 4,241,924 | 12/1980 | Arcara | 273/277 |
| 4,696,476 | 9/1987 | Eplett | 273/241 |
| 5,074,556 | 12/1991 | Loeppky et al. | 273/108.5 |
| 5,110,127 | 5/1992 | Potter | 273/108.5 X |
| 5,221,084 | 6/1993 | Stelmach | 273/277 X |
| 5,405,141 | 4/1995 | Wilkes | 273/247 |
| 5,423,537 | 6/1995 | Santana | 273/108.5 |
| 5,431,397 | 7/1995 | Eckel et al. | 273/284 X |

*Primary Examiner*—Raleigh W. Chiu

[57] ABSTRACT

A new multi-game table top system for providing a table top which converts into a multi-game recreational area allowing multiple people to utilize said table top for recreational purposes such as golf, soccer, or hockey, and thereafter reverting to the table top's original purpose. The inventive device includes a reticulated table top, a golf transparent board, a soccer transparent board, and a hockey transparent board where said boards are removably securable to the upper surface of the reticulated table top by a plurality of securing magnets around the edges. The reticulated table top is constructed from steel coated with a permanently bonded plastisol coating approximately one-quarter of an inch.

20 Claims, 5 Drawing Sheets

MULTI-GAME TABLE TOP SYSTEM

CROSS REFERENCE TO RELATED APPLICATION

This application is a continuation-in-part of my prior utility patent application Ser. No. 08/689,597, filed Aug. 12, 1996 abandoned.

BACKGROUND OF THE INVENTION

1. Field of the Invention

The present invention relates to game devices and more particularly pertains to a new multi-game table top system for providing a table top which converts into a multi-game recreational area allowing multiple people to utilize said table top for recreational purposes such as golf, soccer, or hockey, and thereafter reverting to the table top's original purpose.

2. Description of the Prior Art

The use of game devices is known in the prior art. More specifically, game devices heretofore devised and utilized are known to consist basically of familiar, expected and obvious structural configurations, notwithstanding the myriad of designs encompassed by the crowded prior art which have been developed for the fulfillment of countless objectives and requireiments.

Known prior art game devices include U.S. Pat. Nos. 4,327,917; 5,131,658; U.S. Design Pat. No. 347,661; U.S. Pat. Nos. 4,776,597; 4,807,412; 5,011,154; 4,241,924; 4,696,476; 5,221,084; 1,875,198; 1,899,546; 3,224,777; 3,871,650; 4,095,793; 4,123,058; 5,074,556; 5,110,127; 5,405,141; 5,423,537; and 5,431,397.

While these devices fulfill their respective, particular objectives and requirements, the aforementioned patents do not disclose a new multi-game table top system. The inventive device includes a reticulated table top, a golf transparent board, a soccer transparent board, and a hockey transparent board where said boards are removably securable to the upper surface of the reticulated table top by a plurality of securing magnets around the edges.

SUMMARY OF THE INVENTION

In view of the foregoing disadvantages inherent in the known types of game devices now present in the prior art, the present invention provides a new multi-game table top system construction wherein the same can be utilized for providing a table top which converts into a multi-game recreational area allowing multiple people to utilize said table top for recreational purposes such as golf, soccer, or hockey, and thereafter reverting to the table top's original purpose.

The general purpose of the present invention, which will be described subsequently in greater detail, is to provide a new multi-game table top system apparatus and method which has many of the advantages of the game devices mentioned heretofore and many novel features that result in a new multi-game table top system which is not anticipated, rendered obvious, suggested, or even implied by any of the prior art game devices, either alone or in any combination thereof.

To attain this, the present invention generally comprises a reticulated table top, a golf transparent board, a soccer transparent board, and a hockey transparent board where said boards are removably securable to the upper surface of the reticulated table top by a plurality of securing magnets around the edges.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is another object of the present invention to provide a new multi-game table top system which may be easily and efficiently manufactured and marketed.

It is a further object of the present invention to provide a new multi-game table top system which is of a durable and reliable construction.

An even further object of the present invention is to provide a new multi-game table top system which is susceptible of a low cost of manufacture with regard to both materials and labor, and which accordingly is then susceptible of low prices of sale to the consuming public, thereby making such multi-game table top system economically available to the buying public.

Still yet another object of the present invention is to provide a new multi-game table top system which provides in the apparatuses and methods of the prior art some of the advantages thereof, while simultaneously overcoming some of the disadvantages normally associated therewith.

Still another object of the present invention is to provide a new multi-game table top system for providing a table top which converts into a multi-game recreational area allowing multiple people to utilize said table top for recreational purposes such as golf, soccer, or hockey, and thereafter reverting to the table top's original purpose.

Yet another object of the present invention is to provide a new multi-game table top system which includes a reticulated table top, a golf transparent board, a soccer transparent board, and a hockey transparent board where said boards are removably securable to the upper surface of the reticulated table top by a plurality of securing magnets around the edges.

Still yet another object of the present invention is to provide a new multi-game table top system that the users can utilize for playing various types of games.

Even still another object of the present invention is to provide a new multi-game table top system that includes an area for retaining drinks during utilization of the present invention.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
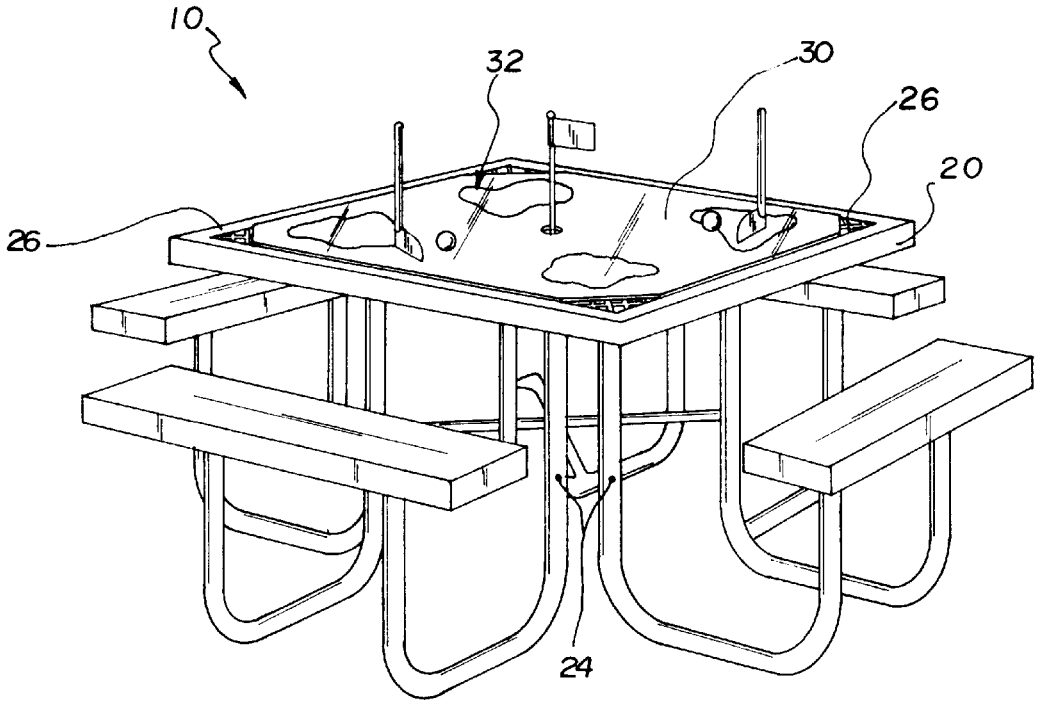
FIG. 1 is a perspective view of a new multi-game table top system according to the present invention.

With reference now to the drawings, and in particular to FIGS. 1 through 10 thereof, a new multi-game table top system embodying the principles and concepts of the present invention and generally designated by the reference numeral 10 will be described.

More specifically, it will be noted that the multi-game table top system 10 comprises a reticulated table top 20 formed into a square shape, a plurality of legs 24 vertically aligned and secured at the top end to the bottom surface of the reticulated table top 20, a golfing transparent board 30 formed to the shape of the reticulated table top 20's upper surface and positioned thereon, a soccer transparent board 40 formed to the shape of the reticulated table top's 20 upper surface and positioned thereon, and a hockey transparent board 50 formed to the shape of the reticulated table top 20's upper surface and positioned thereon.

Figure 2:
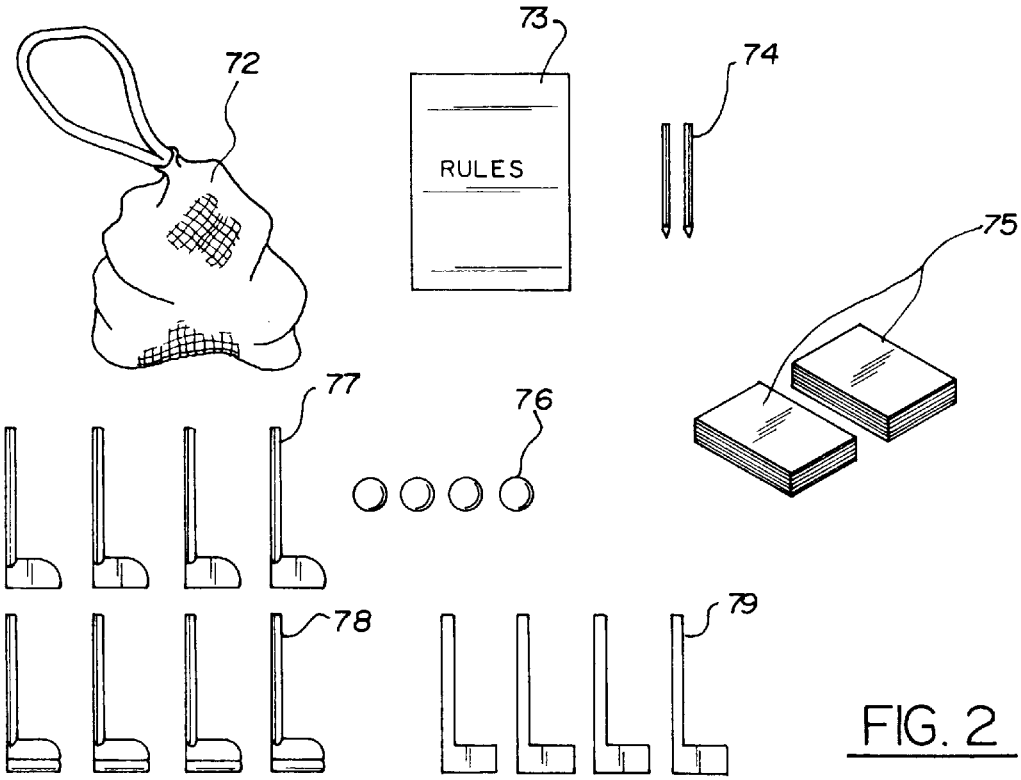
FIG. 2 is a top view of the accessories to the present invention.
Figure 3:
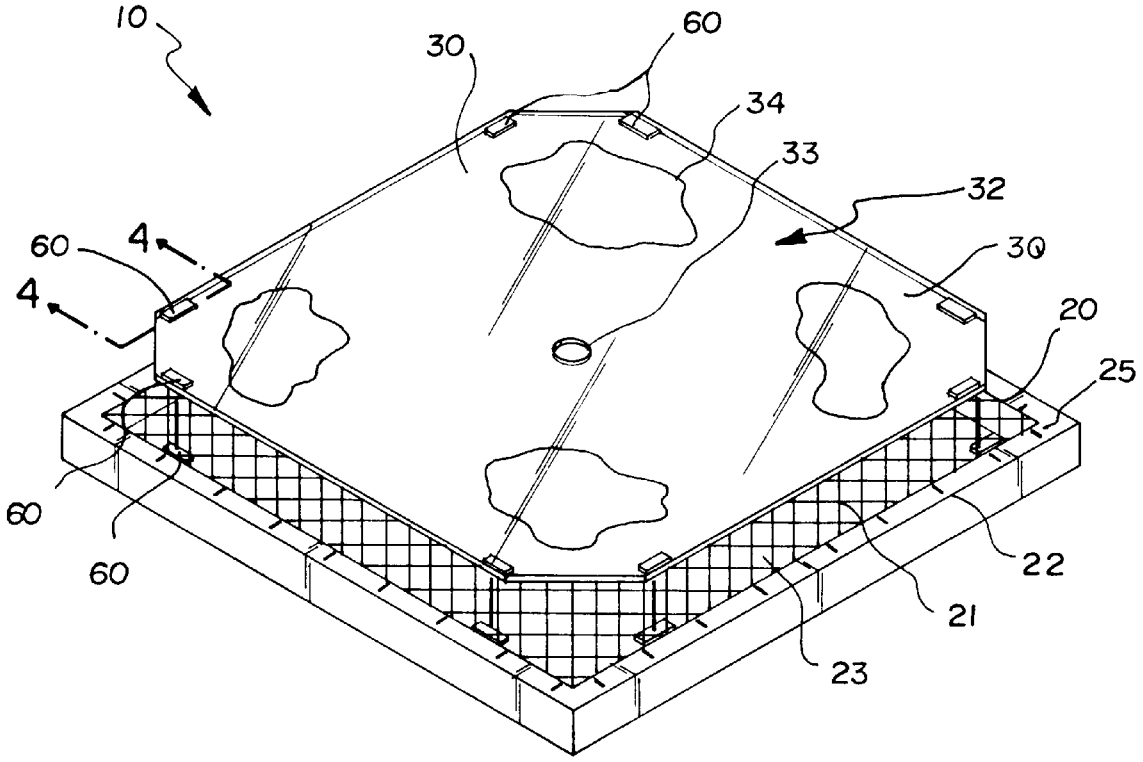
FIG. 3 is a perspective view of the golfing transparent board.
Figure 4:
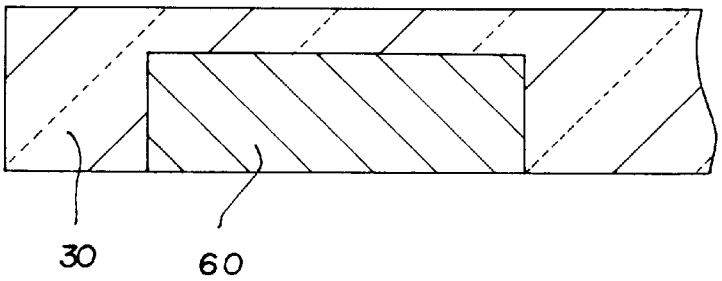
FIG. 4 is a cross sectional view taken along line 4—4 of FIG. 3.
Figure 5:
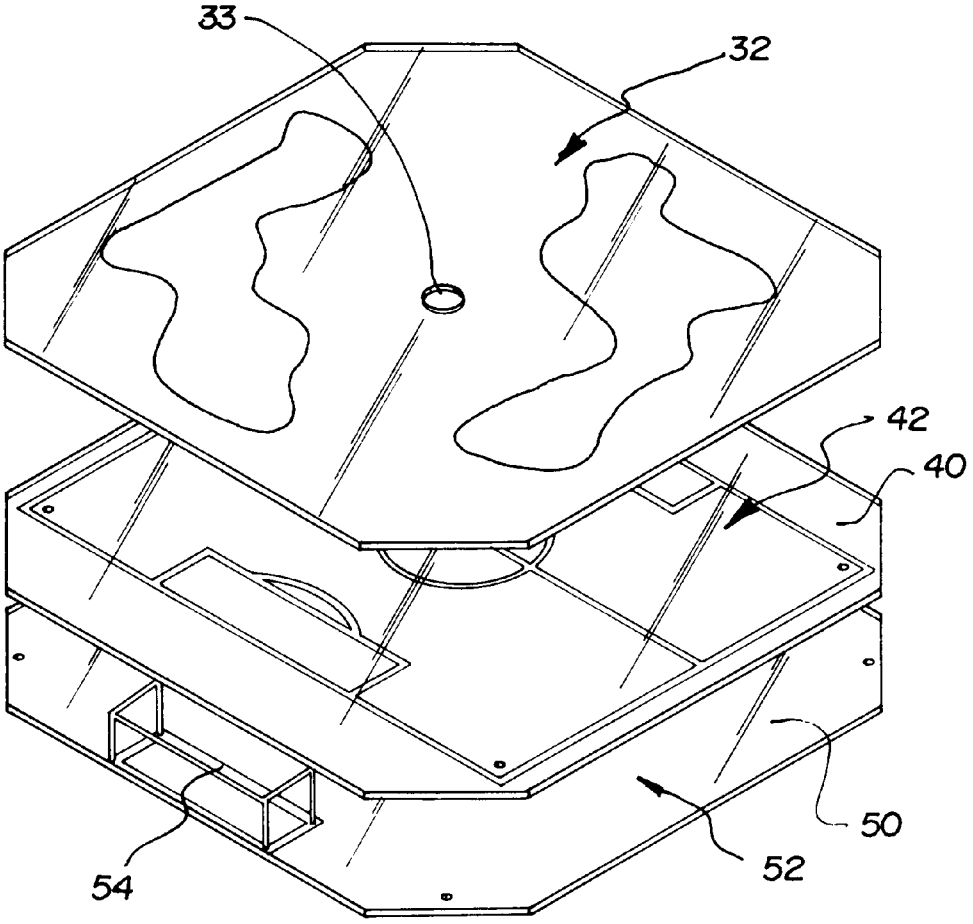
FIG. 5 is a perspective view of all three boards vertically aligned.
Figure 6:
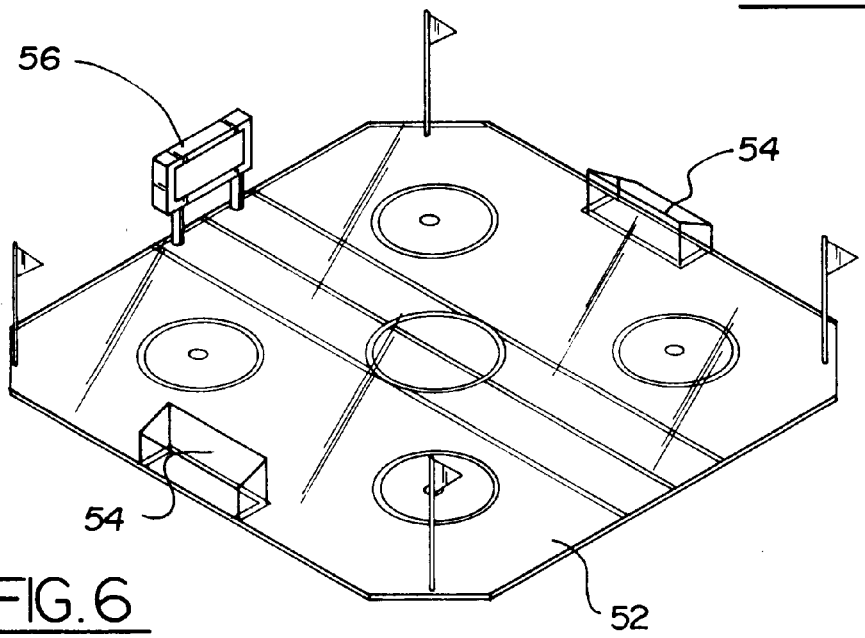
FIG. 6 is a perspective view of the hockey transparent board including the hockey goals and the scoreboard.
Figure 7:
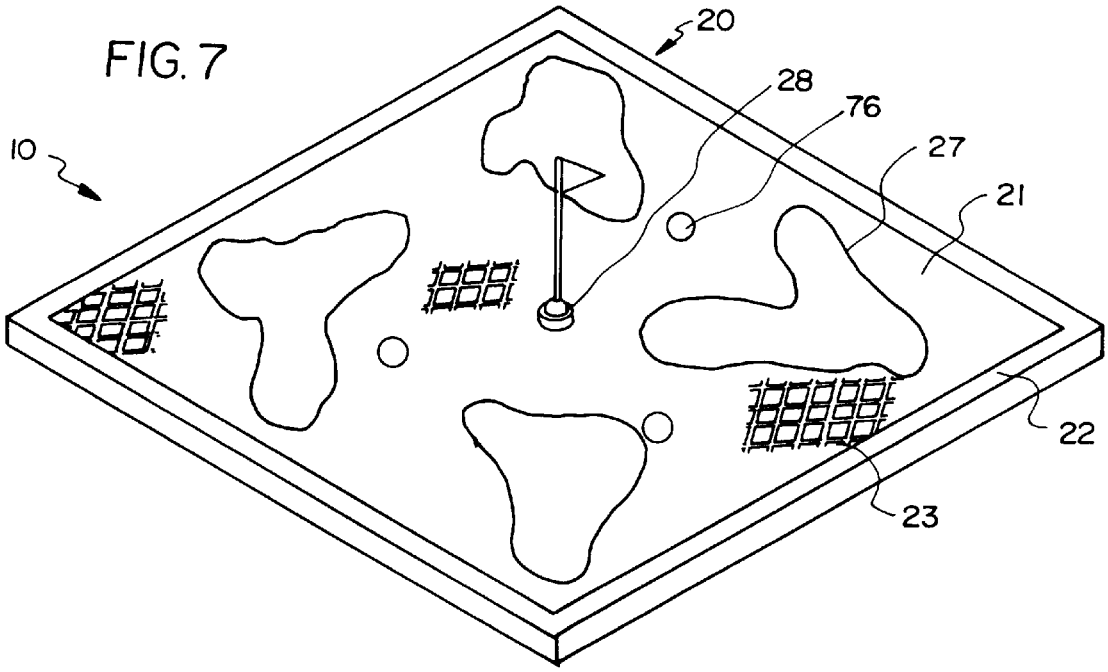
FIG. 7 is a perspective view of the table top detailing the lattice portion.
Figure 8:
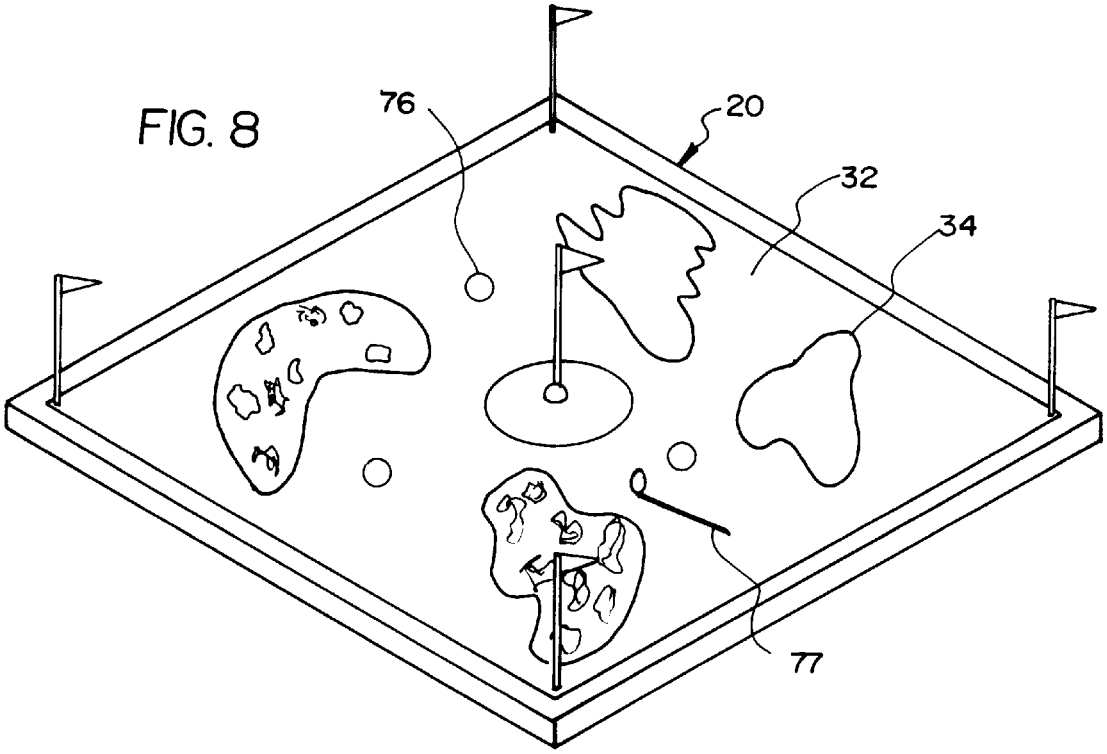
FIG. 8 is a perspective view of the golf game overlay on the table top.

As best illustrated in FIGS. 1 through 10, it can be shown that the said boards 30, 40, 50 include unnumbered cutouts at each corner thereby forming a forty-five degree angle edge with each of adjacent sides and exposing a drink area 26 on the reticulated table top 20. The golfing transparent board 30 includes a centrally positioned ball aperture 33, and a golf course overlay 32 designed to the appearance of a golf course as best shown in FIG. 5 of the drawings. The soccer transparent board 40 includes a soccer field overlay 42 designed to the appearance of a soccer field as shown in FIG. 5 of the drawings. The hockey transparent board 50 includes a hockey arena overlay 52 designed to the appearance of a hockey arena as best shown in FIG. 6 of the drawings. A pair of hockey goals 54 are secured at opposing edges of the hockey transparent board 50. A scoreboard 56 is secured to an edge adjacent to the hockey goals 54. The boards 30, 40, 50 are removably secured to the reticulated table top 20 individually by a plurality of securing magnets 60 secured to the boards and the reticulated table top 20 in corresponding positions so as to be juxtaposed to one another when one board is positioned on the reticulated table top's 20 upper surface as best shown in FIGS. 3 and 4 of the drawings. As shown in FIG. 2 of the drawings, the present invention further includes accessories comprising a rule book 73, at least one pencil 74, a plurality of score cards 75, at least one playing ball 76, a plurality of miniature golf clubs 77 which engage a playing ball 76, a plurality of soccer sticks 78 which engage a playing ball 76, a plurality of miniature hockey sticks 79 which engage a playing ball 79, and a drawstring carrying bag 72 for storing above stated accessories. The reticulated table top 20 is preferably formed from steel coated with a permanently bonded plastisol coating which is approximately one-quarter of an inch thick, thereby providing increased strength and lightweight. In other words, preferably, the lattice 21 comprises expanded metal having a plastic coating thereover.

In use, the user secures the desired board 30, 40, or 50 to the reticulated table top's 20 upper surface. The securing magnets 60 retain the board 30, 40, or 50. The user then positions any required accessories required for playing the chosen game. For example, the hockey transparent board 50 includes the pair of hockey goals 54 which receive the playing ball 76 which is engaged by the miniature hockey stick 79 gripped by the user. Corresponding activity is performed with the golfing transparent board 30 and the soccer transparent board 40. The user is further able to rest drinks during play on the drink area 26. When the user chooses to play another board, the user simply removes the attached board 30, 40, or 50 and positions the different desired board 30, 40, or 50 upon the reticulated table top's 20 upper surface.

In closer detail, the table top 20 is generally rectangular and has a lattice portion 21 and an outer perimeter 22 surrounding the lattice portion. As illustrated in FIG. 1, a support structure 24 may be coupled to the table top 20 for supporting the table top 20 above a ground surface. The lattice portion 21 is generally rectangular and defines a grid of apertures 23 through it. Each of the apertures 23 is sized to permit a portion of the game ball 76 on the upper surface of the lattice portion 21 to be disposed in the aperture 23 such that the rolling of the game ball 76 on the upper surface of the lattice portion 21 is limited. The lattice portion 21 also has an upper surface, a center, opposite first and second sides, and opposite third and fourth sides extending between the first and second sides. The lattice portion also has a hole 33 located at the center of the lattice portion 21.

As illustrated in FIG. 3, the outer perimeter 22 of the table top 20 having a plurality of spaced apart marks 25 displayed thereon. The marks 25 are designed for positioning the game ball 76 adjacent thereto such that a player may attempt to hit the game ball 76 towards the hole at the center of the lattice portion 21. Preferably, the upper surface of the lattice portion 21 has indicia thereon representing a plurality of hazard regions 27. The hazard regions 27 are designed for adding a stroke to a player's score when the player hits their associated game ball 76 into one of the hazard regions 27.

Figure 9:
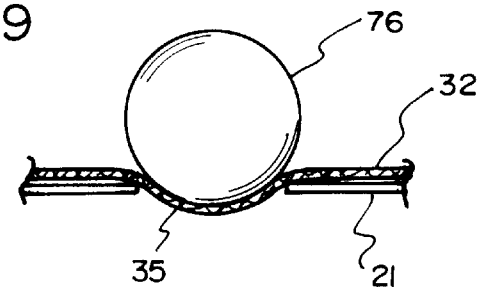
FIG. 9 is a sectional view illustrating the game ball resting in an indentation on an overlay formed by the lattice portion.

The game system also includes a plurality of flexible overlays 32,42,52. These overlays may, as mentioned previously, or may not be transparent. The overlays include a flexible golfing overlay 32 for playing a golfing game. The golfing overlay 32 is generally rectangular and has an upper surface. The center of the golfing overlay has a hole 33 therethrough. The golfing overlay 32 is restable on the upper surface of the lattice portion 21 such that the plurality of apertures 23 of the lattice portion 21 form a plurality of corresponding indentations 35 in the upper surface of the golfing overlay, as illustrated in FIG. 9. Each of the indentations 35 of the golfing overlay 32 is sized to permit a portion of the game ball 76 on the upper surface of the golfing overlay 32 to be disposed in the indentation 35 such that the rolling of the game ball 76 on the upper surface of the golfing overlay is limited. The hole 33 of the golfing overlay 32 is positionable or alignable over the hole at the center of the lattice portion 21 when the golfing overlay is rested on the upper surface of the lattice portion 21.

The upper surface of the golfing overlay 32 has indicia thereon representing a plurality of hazard regions 34 which are designed for adding a stroke to a player's score when the player hits their associated game ball 76 into one of the hazard regions of the golfing overlay. In play, the golfing game has a plurality of rounds, with each player having a the game ball 76. A round of the golfing game is played by each player attempting in alternating turns to hit their associated game ball 76 with their associated striking stick or finger starting from a position adjacent one of the marks 25 of the outer perimeter 22 of the table top 20 into the hole 33 at the center of the lattice portion 21, wherein each hit of the game ball 76 by a player counts as a stroke. The player using the fewest number of strokes to direct their associated game ball 76 into the hole at the center of the lattice portion 21 wins the round of the golfing game.

Figure 10:
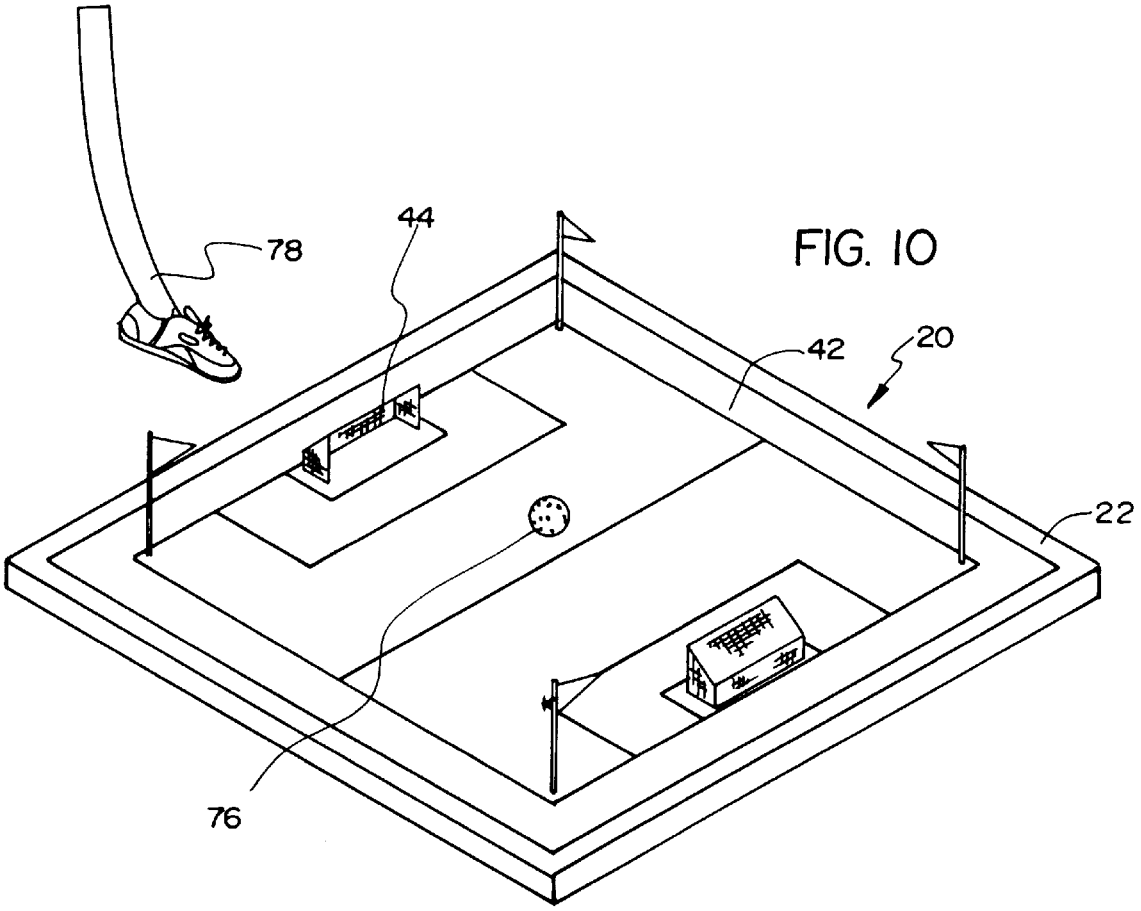
FIG. 10 is a perspective view of the soccer game overlay.

Similarly, as illustrated in FIG. 10, the overlays may include a flexible soccer overlay 42 for playing a soccer game. Like the other overlays, the soccer overlay 42 is generally rectangular and has an upper surface. Like the golf overlay 32, the soccer overlay 42 is restable on the upper surface of the lattice portion 21 such that the plurality of apertures of the lattice portion 21 form a plurality of corresponding indentations 35 in the upper surface of the soccer overlay 42. The upper surface of the soccer overlay 42 has indicia thereon representing a soccer field. A pair of soccer goals 44 are provided with one of the soccer goals positioned on the upper surface of the soccer overlay towards the first side of the lattice portion 21 and the other soccer goal positionable on the upper surface of the soccer overlay towards the second side of the lattice portion 21. The soccer game is played by each player attempting in alternating turns to hit the game ball 76 with their associated striking stick or finger towards the soccer goal associated with another player. The player scores a goal by hitting the game ball 76 into the soccer goal associated with another player.

The overlays may also include a flexible hockey overlay 52 for playing a hockey game. Like the other overlays, the hockey overlay 52 is generally rectangular and having an upper surface and is restable on the upper surface of the lattice portion 21 such that the plurality of apertures of the lattice portion 21 form a plurality of corresponding indentations in the upper surface of the hockey overlay. The upper surface of the hockey overlay includes indicia thereon representing a hockey rink. A pair of hockey goals 54 are provided and are positionable on the overlay in a similar fashion like the soccer goals on the soccer overlay. The hockey game is played by each player attempting in alternating turns to hit the game ball 76 with their associated striking stick or finger towards the hockey goal associated with another player. The player scores a goal by hitting the game ball 76 into the hockey goal associated with another player.

Optionally, a stopper 28 may be included for substantially closing the hole at the center of the lattice portion 21 to help permit play with the hockey and soccer overlay.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A table top game system comprising:

a game ball;

a striking stick for each player;

a table top having a generally rectangular outer perimeter with opposite first and second sides, and opposite third and fourth sides extending between said first and second sides, said table top having a lattice portion extending between said sides of said outer perimeter such that said lattice portion is substantially coextensive with said outer perimeter;

said lattice portion defining a grid of apertures covering the entire area of the table top between the sides of the outer perimeter, said lattice portion having an upper surface and a center, each of said apertures being sized to permit a portion of said game ball on said upper surface or said lattice portion to be disposed in said aperture such that the rolling of said game ball over the entire said upper surface of said lattice portion is affected by said apertures;

said upper surface of said lattice portion having indicia marked thereon representing a plurality of hazard regions, said hazard regions being for adding a stroke to a player's score when the player hits their associated game ball into one of said hazard regions; and wherein a golfing game can be played on said table top using said game ball and said striking stick, said golfing game having a plurality of rounds, wherein each player has a said game ball, wherein a round of said golfing game is played by each player attempting in alternating turns to hit their associated game ball with their associated striking stick starting from a position adjacent one of said marks of said outer perimeter of said table top into said hole at said center of said lattice portion, wherein each hit of said game ball by player counts as a stroke.

2. The table top game system of claim 1, wherein said outer perimeter of said table top has a plurality of spaced apart marks being displayed thereon, said marks of said outer perimeter of said table top being for positioning said game ball adjacent thereto such that a player may attempt to hit said game ball towards said hole at said center of said portion.

3. The table top game system of claim 1, wherein said lattice portion has a hole therethrough located at said center of said lattice portion, and additionally comprising a flexible golfing overlay for playing a golfing game, said golfing overlay being generally rectangular and having an upper surface and a center, said center of said golfing overlay having a hole therethrough, said golfing overlay being restable on said upper surface of said lattice portion such that said plurality of aperturees of said lattice portion form a plurality of corresponding indentations in said upper surface of said golfing overlay, each of said indentations of said golfing overlay being sized to permit a portion of said game ball on said upper surface of said golfing overlay to be disposed in said indentation such that the rolling of said game ball on said upper surface of said golfing overlay is limited, said hole of said golfing overlay being positionable over said hole at said center of said lattice portion when said golfing overlay is rested on said upper surface of said lattice portion; and said upper surface of said golfing overlay having indicia thereon representing a plurality of hazard regions, said hazard regions of said golfing overlay being for adding a stroke to a player's score when the player hits their associated game ball into one of said hazard regions of said golfing overlay.

4. The table top game system of claim 1, additionally comprising a flexible soccer overlay for playing a soccer game, said soccer overlay being generally rectangular and having an upper surface, said soccer overlay being restable on said upper surface of said lattice portion such that said plurality of apertures of said lattice portion form a plurality of corresponding indentations in said upper surface of said soccer overlay, each of said indentations of said soccer overlay being sized to permit a portion of said game ball on said upper surface of said soccer overlay to be disposed in said indentation such that the rolling of said game ball on said upper surface of said soccer overlay is limited;

said upper surface of said soccer overlay having indicia thereon representing a soccer field;

a pair of soccer goals, one of said soccer goal being positionable on said upper surface of said soccer overlay towards said first side of said lattice portion, the other soccer goal being positionable on said upper surface of said soccer overlay towards said second side of said lattice portion; and wherein said soccer game is played by each player attempting in alternating turns to hit said game ball with their associated striking stick towards the soccer goal associated with another player, wherein the player scores a goal by hitting said game ball into the soccer goal associated with another player.

5. The table top game system of claim 1, additionally comprising a flexible hockey overlay for playing a hockey game, said hockey overlay being generally rectangular and having an upper surface, said hockey overlay being restable on said upper surface of said lattice portion such that said plurality of apertures of said lattice portion form a plurality of corresponding indentations in said upper surface of said hockey overlay, each of said indentations of said hockey overlay being sized to permit a portion of said game ball on said upper surface of said hockey overlay to be disposed in said indentation such that the rolling of said game ball on said upper surface of said hockey overlay is limited;

said upper surface of said hockey overlay having indicia thereon representing a hockey rink;

a pair of hockey goals, one of said hockey goals being positionable on said upper surface of said hockey overlay towards said first side of said lattice portion, the other hockey goal being positionable on said upper surface of said hockey overlay towards said second side of said lattice portion; and wherein said hockey game is played by each player attempting in alternating turns to hit said game ball with their associated striking stick towards the hockey goal associated with another player, wherein the player scores a goal by hitting said game ball into the hockey goal associated with another player.

6. The table top game system of claim 1, further comprising a support structure being coupled to said table top, said support structure being for supporting said table top above a ground surface.

7. The table top game system of claim 1, additionally including:

a rule book;

at least one pencil;

a plurality of score cards;

a plurality of miniature golf clubs for striking said game ball;

a plurality of soccer sticks for striking said game ball;

a plurality of miniature hockey sticks for striking said game ball; and a drawstring carrying bag for storage of accessories.

8. The table top game system of claim 7, wherein the lattice portion of said table top is formed from expanded metal coated with a permanently bonded plastisol coating which is appoximately one-quarter of an inch thick.

9. A table top game system, comprising:

a game ball;

a striking stick for each player;

a table top being generally rectangular and having a lattice portion and an outer perimeter;

said lattice portion defining a grid of apertures therethrough, said lattice portion being generally rectangular and having an upper surface, a center, opposite first and second sides, and opposite third and fourth sides extending between said first and second sides, each of said apertures being sized to permit a portion of said game ball on said upper surface of said lattice portion to be disposed in said aperture such that the rolling of said game ball on said upper surface of said lattice portion is limited;

said lattice portion having a hole being located at said center of said lattice portion;

said outer perimeter of said table top having a plurality of spaced apart marks being displayed thereon, said marks of said outer perimeter of said table top being for positioning said game ball adjacent thereto such that a player may attempt to hit said game ball towards said hole at said center of said lattice portion;

said upper surface of said lattice portion having indicia thereon representing a plurality of hazard regions, said hazard regions being for adding a stroke to a player's score when the player hits their associated game ball into one of said hazard regions; and wherein a golfing game can be played on said table top using said game ball and said striking stick, said golfing game having a plurality of rounds, wherein each player has a said game ball, wherein a round of said golfing game is played by each player attempting in alternating turns to hit their associated game ball with their associated striking stick starting from a position adjacent one of said marks of said outer perimeter of said table top into said hole at said center of said lattice portion, wherein each hit of said game ball by a player counts as a stroke.

10. The table top game system of claim 9, further comprising a support structure being coupled to said table top, said support structure being for supporting said table top above a ground surface.

11. The game table top system of claim 9, wherein said lattice portion comprises expanded metal.

12. The table top game system of claim 11, wherein said lattice portion further comprises a plastic coating over said expanded metal.

13. The table top game system of claim 9, further comprising a flexible golfing overlay for playing a golfing game, said golfing overlay being generally rectangular and having an upper surface and a center, said center of said golfing overlay having a hole therethrough, said golfing overlay being restable on said upper surface of said lattice portion such that said plurality of apertures of said lattice portion form a plurality of corresponding indentations in said upper surface of said golfing overlay, each of said indentations of said golfing overlay being sized to permit a portion of said game ball on said upper surface of said golfing overlay to be disposed in said indentation such that the rolling of said game ball on said upper surface of said golfing overlay is limited, said hole of said golfing overlay being positionable over said hole at said center of said lattice portion when said golfing overlay is rested on said upper surface of said lattice portion; and said upper surface of said golfing overlay having indicia thereon representing a plurality of hazard regions, said hazard regions of said golfing overlay being for adding a stroke to a player's score when the player hits their associated game ball into one of said hazard regions of said golfing overlay.

14. The table top game system of claim 9, further comprising a flexible soccer overlay for playing a soccer game, said soccer overlay being generally rectangular and having an upper surface, said soccer overlay being restable on said upper surface of said lattice portion form a plurality of corresponding indentations in said upper surface of said soccer overlay, each of said indentations of said soccer overlay being sized to permit a portion of said game ball on said upper surface of said soccer overlay to be disposed in said indentation such that the rolling of said game ball on said upper surface of said soccer overlay is limited;

said upper surface of said soccer overlay having indicia thereon representing a soccer field;

a pair of soccer goals, one of said soccer goals being positionable on said upper surface of said soccer overlay towards said first side of said lattice portion, the other soccer goal being positionable on said upper surface of said soccer overlay towards said second side of said lattice portion; and wherein said soccer game is played by each player attempting in alternating turns to hit said game ball with their associated striking stick towards the soccer goal associated with another player, wherein the player scores a goal by hitting said game ball into the soccer goal associated with another player.

15. The table top game system of claim 14, wherein said striking stick is formed to resemble a soccer shoe for playing a soccer game.

16. The table top game system of claim 9, further comprising a flexible hockey overlay for playing a hockey game, said hockey overlay being generally rectangular and having an upper surface, said hockey overlay being restable on said upper surface of said lattice portion such that said plurality of apertures of said lattice portion form a plurality of corresponding indentations in said upper surface of said hockey overlay, each of said indentations of said hockey overlay being sized to permit a portion of said game ball on said upper surface of said hockey overlay to be disposed in said indentation such that the rolling of said game ball on said upper surface of said hockey overlay is limited;

said upper surface of said hockey overlay having indicia thereon representing a hockey rink;

a pair of hockey goals, one of said hockey goals being positionable on said upper surface of said hockey overlay towards said first side of said lattice portion, the other hockey goal being positionable on said upper surface of said hockey overlay towards said second side of said lattice portion; and wherein said hockey game is played by each player attempting in alternating turns to hit said game ball with their associated striking stick towards the hockey goal associated with another player, wherein the player scores a goal by hitting said game ball into the hockey goal associated with another player.

17. The table top game system of claim 11, wherein said striking stick is formed to resemble a hockey stick for playing a hockey game.

18. The table top game system of claim 16, further comprising a stopper for substantially closing said hole at said center of said lattice portion, said stopper being for helping permit play with the hockey overlay.

19. The table top game system of claim 9, wherein said striking stick is formed to resemble a golf club for playing a golf game.

20. A table top game system, comprising:

a game ball;

a striking stick for each player;

a table top being generally rectangular and having a lattice portion and an outer perimeter;

a support structure being coupled to said table top, said support structure being for supporting said table top above a ground surface;

said lattice portion defining a grid of apertures therethrough, said lattice portion being generally rectangular and having an upper surface, a center, opposite first and second sides, and opposite third and fourth sides extending between said first and second sides, each of said apertures being sized to permit a portion of said game ball on said upper surface of said lattice portion to be disposed in said aperture such that the rolling of said game ball on said upper surface of said lattice portion is limited;

said lattice portion having a hole being located at said center of said lattice portion;

wherein said lattice portion comprises expanded metal, wherein said lattice portion further comprised a plastic coating over said expanded metal;

said outer perimeter of said table top having a plurality of spaced apart marks being displayed thereon, said marks of said outer perimeter of said table top being for positioning said game ball adjacent thereto such that a player may attempt to hit said game ball towards said hole at said center of said lattice portion;

a stopper for substantially closing said hole at said center of said lattice portion;

said upper surface of said lattice portion having indicia thereon representing a plurality of hazard regions, said hazard regions being for adding a stroke to a player's score when the player hits their associated game ball into one of said hazard regions;

a flexible golfing overlay for playing a golfing game, said golfing overlay being generally rectangular and having an upper surface and a center, said center of said golfing overlay having a hole therethrough, said golfing overlay being restable on said upper surface of said lattice portion such that said plurality of apertures said lattice portion form a plurality of corresponding indentations in said upper surface of said golfing overlay, each of said indentations of said golfing overlay being sized to permit a portion of said game ball on said upper surface of said golfing overlay to be disposed in said indentation such that the rolling of said game ball on said upper surface of said golfing overlay is limited, said hole of said golfing overlay being positionable over said hole at said center of said lattice portion when said golfing overlay is rested on said upper surface of said lattice portion upper surface of said golfing overlay having indicia thereon representing a plurality of hazard regions, said hazard regions of said golfing overlay being for adding a stroke to a player's score when the player hits their associated game ball into one of said hazard regions of said golfing overlay;

wherein said golfing game has a plurality of rounds, wherein each player has a said game ball, wherein a round of said golfing game is played by each player attempting in alternating turns to hit their associated game ball with their associated striking stick starting from a position adjacent one of said marks of said outer perimeter of said table top into said hole at said center of said lattice portion, wherein each hit of said game ball by a player counts as a stroke, wherein the player using the fewest number of strokes to direct their associated game ball into said hole at said center of said lattice portion wins said round of said golfing game;

a flexible soccer overlay for playing a soccer game, said soccer overlay being generally rectangular and having an upper surface, said soccer overlay being restable on said upper surface of said lattice portion such that said plurality of apertures of said lattice portion form a plurality of corresponding indentations in said upper surface of said soccer overlay, each of said indentations of said soccer overlay being sized to permit a portion of said game ball on said upper surface of said soccer overlay to be disposed in said indentation such that the rolling of said game ball on said upper surface of said soccer overlay is limited;

said upper surface of said soccer overlay having indicia thereon representing a soccer field;

a pair of soccer goals, one of said soccer goals being positionable on said upper surface of said soccer overlay towards said first side of said lattice portion, the other soccer goal being positionable on said upper surface of said soccer overlay towards said second side of said lattice portion;

wherein said soccer game is played by each player attempting in alternating turns to hit said game ball with their associated striking stick towards the soccer goal associated with another player, wherein the player scores a goal by hitting said game ball into the soccer goal associated with another player;

a flexible hockey overlay for playing a hockey game, said hockey overlay being generally rectangular and having an upper surface, said hockey overlay being restable on said upper surface of said lattice portion such that said plurality of apertures of said lattice portion form a plurality of corresponding indentations in said upper surface of said hockey overlay, each of said indentations of said hockey overlay being sized to permit a portion of said game ball on said upper surface of said hockey overlay to be disposed in said indentation such that the rolling of said game ball on said upper surface of said hockey overlay is limited;

said upper surface of said hockey overlay having indicia thereon representing a hockey rink;

a pair of hockey goals, one of said hockey goals being positionable on said upper surface of said hockey overlay towards said first side of said lattice portion, the other hockey goal being positionable on said upper surface of said hockey overlay towards said second side of said lattice portion;

wherein said hockey game is played by each player attempting in alternating turns to hit said game ball with their associated striking stick towards the hockey goal associated with another player, wherein the player scores a goal by hitting said game ball into the hockey goal associated with another player.

* * * * *